US005548089A

United States Patent [19]

Yamat

[11] Patent Number: 5,548,089

[45] Date of Patent: Aug. 20, 1996

[54] BUSHING FOR GAS-INSULATED SWITCHGEAR

[75] Inventor: Miguel B. Yamat, Franklin, Wis.

[73] Assignee: Cooper Industries, Inc., Houston, Tex.

[21] Appl. No.: 182,790

[22] Filed: Jan. 13, 1994

[51] Int. Cl.[6] ..... H01B 17/50

[52] U.S. Cl. ..... 174/142; 174/18; 174/144; 174/152 R

[58] Field of Search ..... 174/142, 144, 174/152 R, 11 BH, 12 BH, 14 BH, 18, DIG. 8, DIG. 10, 140 C; 361/604, 605

[56] References Cited

U.S. PATENT DOCUMENTS

| | | | |
|---|---|---|---|
| 3,819,851 | 6/1974 | Nigol | 174/140 C X |
| 4,252,692 | 2/1981 | Taylor et al. | 252/504 |
| 4,291,192 | 9/1981 | Eccleston et al. | 174/11 BH |
| 4,312,123 | 1/1982 | Wheeler | 174/143 X |
| 4,563,544 | 1/1986 | Bui et al. | 174/140 C |
| 4,670,625 | 6/1987 | Wood et al. | 174/142 |
| 5,130,495 | 7/1992 | Thompson | 174/73.1 |

OTHER PUBLICATIONS

Raychem; *Material Safety Data Sheet* for Heat Shrinkable Polymeric Products; Serial No. RAY; 4566; Jul. 1990; Arkene Klonoff, Corporate Quality Assurance; (2 pg.).

3M Product Data Sheet; *Electrodag 213 Conductive Coating;* 1990; (4 pg.).

*Primary Examiner*—Kristine L. Kincaid
*Assistant Examiner*—Paramita Ghosh
*Attorney, Agent, or Firm*—Conley, Rose & Tayon, P.C.

[57] ABSTRACT

A bushing wherein the voltage stress across the surface of the bushing is alleviated by placement of a layer of insulating material in direct contact with the surface. The insulating material is preferably a high-voltage type, heat-shrinkable, halogen-free polyolefin, and is preferably fully shrunk to conform to the contours of the outer surface of the bushing.

7 Claims, 1 Drawing Sheet

BUSHING FOR GAS-INSULATED SWITCHGEAR

FIELD OF THE INVENTION

The present invention relates to bushings useful for making connections to electrical switchgear. More particularly, the present invention relates to an easily removable bushing having improved dielectric properties and improved arc-tracking resistance for use in gas-insulated switchgear.

BACKGROUND OF THE INVENTION

The bushings of the present invention are used to connect high voltage lines to padmounted and subsurface electrical switchgear. Such switchgear are typically mounted within sealed housings and insulated with oil. The bushings used in these applications are typically bolted to the external surface of the wall of the switchgear housing and can easily be removed for repair or replacement. Recently, the electrical distribution industry has begun to use padmounted and subsurface switchgear in which sulfur hexafiouride ($SF_6$) replaces oil as the insulating medium. $SF_6$ gas is preferable to oil in many instances where safety is an issue, in part because it decreases the risk of explosion. Because $SF_6$ is less insulating than oil along surfaces of solid insulators, bushings used in $SF_6$-insulated applications must have greater resistance to arcing than those used in oil-insulated applications. Arcing can occur either through the medium surrounding the components, or can occur across the surface of the components. The latter phenomenon is called are tracking.

When $SF_6$ is used as the insulating medium, however, greater precautions must be taken to prevent the gas from escaping, because its presence is necessary primarily to preserve the insulation integrity of the switchgear. Bushings designed for use in $SF_6$ applications are typically designed to be welded to the bushing housing in order to form an unbroken joint and thereby eliminate the need for elastomeric seals, which can be affected by the insulating gas. Presently, bushings designed to be welded to the housing wall have several disadvantages. First, because it is not practical to un-weld and re-weld a bushing in the field, the entire switchgear is typically removed to an operating facility when a connection needs to be replaced or repaired. This is costly and inefficient. Second, weld-mounted bushings typically include an integral metal flange molded into the bushing body, for welded attachment to the housing wall. The inclusion of this flange in the bushing body adds complexity to the manufacture of molded bushings, with the result that welded bushings are not available in as many configurations as are bolt-mounted bushings.

In contrast, bolted-mounted bushings designed for use with oil-insulated switchgear are in abundant supply and are relatively easy to manufacture and install. However, when a bolt-mounted bushing is used in a gas-insulated environment, the dielectric properties of the bushing are generally not adequate to withstand the voltage stress and dielectric breakdown results. Specifically, the shank of the bushing is shorter and includes a shielding layer of semiconductive material around its middle. The inner edge of the shielding layer is the site of significant voltage stress. Hence, it is desired to provide a bolt-mounted bushing that is simple and inexpensive to manufacture and install, yet suitable for use in gas-insulated switchgear.

SUMMARY OF THE INVENTION

The present invention comprises the application of an insulating layer over the outer surface of the inner shank of a bolt-mounted bushing. The insulating layer is preferably in direct contact with the bushing surface and preferably comprises a high voltage type heat-shrinkable tubing. The insulating layer overlaps the inner edge of any shielding layer, thereby reducing the localized voltage stresses between that edge and the high-voltage connection. Additionally, the insulating layer having higher dielectric properties as compared to the bushing material prevents the tendency to arc track over the surface.

BRIEF DESCRIPTION OF THE DRAWING

For a detailed description of a preferred embodiment of the invention reference will now be made to the accompanying drawings wherein.

DETAILED DESCRIPTION OF THE PREFERRED EMBODIMENT

Figure 1:
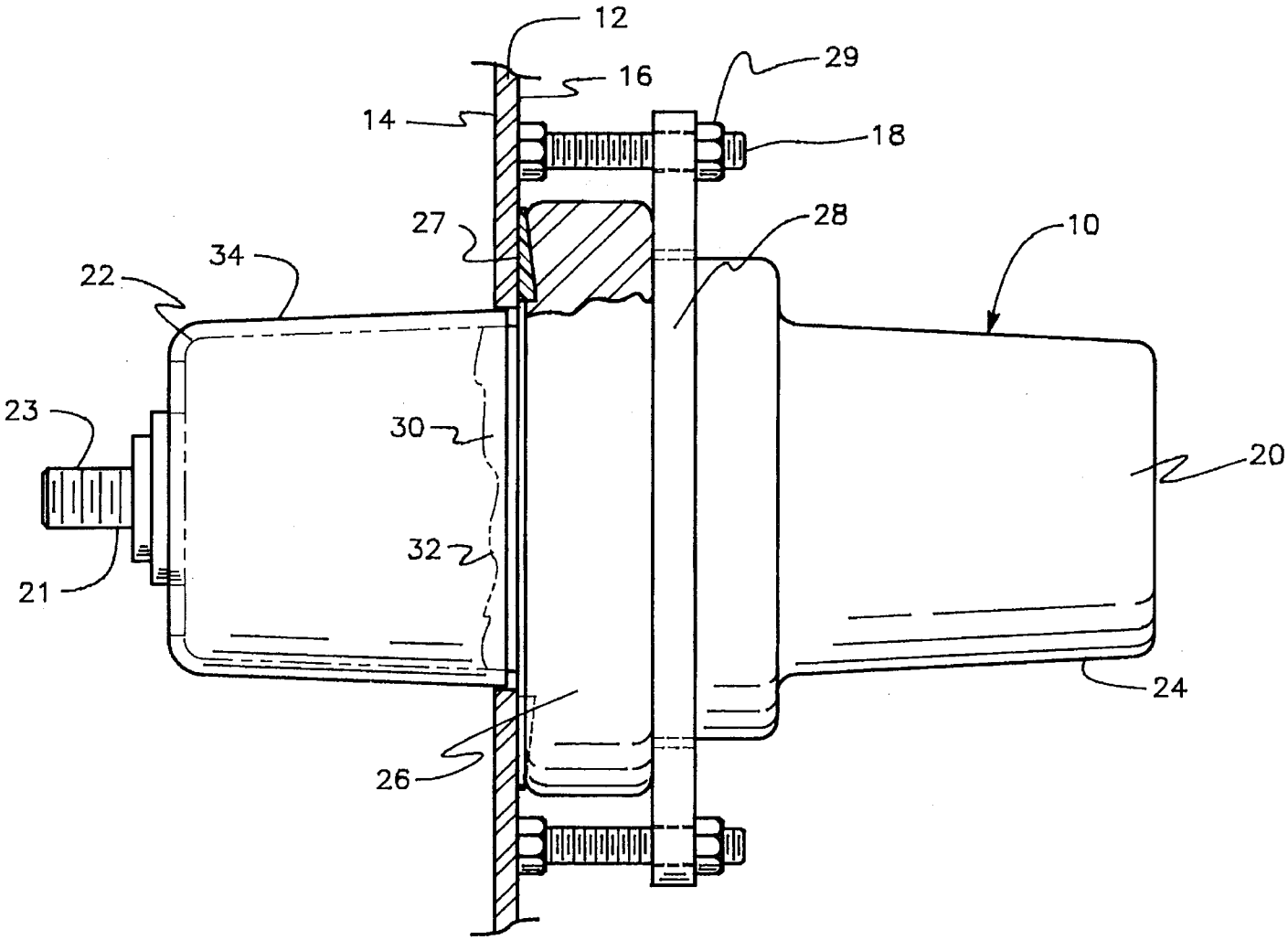
FIG. 1 is an elevation view of the bushing of the present invention, partially in cross-section.

Referring to FIG. 1, a bushing 10 is shown mounted through a wall 12 of a switchgear housing. The housing contains the switchgear (not shown) and an insulating medium, such as $SF_6$ gas. Wall 12 has an inner surface 14 and an outer surface 16. A plurality of mounting studs 18 extend outward from outer surface 16. Bushing 10 comprises a non-conductive body 20 that extends through wall 12 and includes an inner shank 22 and an outer shank 24. Extending through body 20 and coaxial therewith is a conducting core 21, which provides the connection between the switchgear and the external electrical components (not shown). Conducting core 21 protrudes beyond shank 22 to form a stud 23.

Between inner shank 22 and outer shank 24 is a radially extending flange 26. A bushing clamp 28 is received over studs 18 and bears on flange 26, so as to retain bushing 20 on wall 12. Clamp 28 is held in place by nuts 29 tightened onto studs 18. Preferably, a gasket 27 is positioned between flange 26 and outer surface 16 of wall 12 and is compressed by the tightening of nuts 29 to ensure adequate sealing of the switchgear housing and containment of the insulating medium therein.

The middle portion of bushing 20, including flange 26, is preferably coated with a semiconductive coating 30, which shields bushing 20 and increases its withstand voltage. Semiconductive coating 30 is preferably a thin layer, such as may be obtained by painting the desired semiconductive material onto bushing 20. An example of a preferred shielding semiconductive coating is Electrodag® 213, manufactured by Acheson Colloids Company of Port Huron, Mich.

It has been found that when bolt-mounted bushings constructed in accordance with the foregoing description are used in an $SF_6$ environment, the inner edge 32 of semiconductive coating 30 creates localized voltage stresses as a result of the high voltage difference between stud 23 and the housing wall, or ground. These stresses are particularly acute when inner edge 32 is uneven. When the voltage stresses become too high, electrical breakdown occurs in the form of an arc between stud 23 of conducting core 21 and semiconductive coating 30, and may cause damage to the bushing or other nearby equipment. Such arcing may be along the surface of inner shank 22, or may be through the $SF_6$ gas itself.

It has further been found that the application of a tightly sealed layer 34 of arc tracking resistant, insulating material to the outer surface of inner shank 22 will mitigate the arcing problem. This is particularly true if layer 34 overlaps the inner edge 32 of semiconductive coating 30. According to a preferred embodiment, insulating layer 34 comprises a layer of heat-shrinkable, halogen-free polyolefin. Examples of the preferred material include the BBI Series Heat Shrinkable Tubing manufactured by 3M of Minneapolis, Minn., and Heat Shrinkable Polymeric Products manufactured by Raychem Corporation of Menlo Park, Calif.

A heat shrinkable layer is preferred because it is easy to apply and results in a uniform, sealed layer that conforms to the outer contours of the bushing. Heat shrinkable tubing is available in several size increments, each of which can shrink as much as 50 percent in diameter. If the proper initial size of heat-shrinkable tubing is selected and the tubing is tightly conformed to inner shank 22, a complete seal between shank 22 and insulating layer 34 will be formed. In addition, it is preferred that layer 34 overlap inner edge 32 of layer 30 by at least ⅛ inch. Applied in this manner, insulating layer 34 will provide adequate protection from electrical breakdown.

When insulating layer 34 is applied in the foregoing manner, it increases the resistance of the bushing to both surface breakdown (arc tracking) and breakdown through the gas insulating medium. Thus, the withstand voltage of the bushing is increased and it becomes usable in the gas-insulated environment for which it was formerly unsuited. Consequently, it is possible to provide inexpensive, bolt-mountable bushings that are capable of operating in an $SF_6$ environment. Likewise, it is possible to adapt existing stocks of bushings originally intended for use in oil, so that they may be used in gas-insulated switchgear. By eliminating the requirement for special welded bushings, flexibility is increased and a significant cost savings is realized.

While a preferred embodiment of the invention has been shown and described, modifications thereof can be made by one skilled in the art without departing from the spirit of the invention.

What is claimed is:

1. A bushing for use in connecting electrical switchgear, comprising:

a body having an inner shank and an outer shank, said body having a conducting core extending therethrough and protruding from said inner shank;

a semiconductive shielding layer on at least a portion of an outer surface of said body and axially spaced apart from said protruding conducting core;

an insulating layer affixed to and covering said inner shank between said shielding layer and said protruding conducting core and overlapping at least a portion of said shielding layer.

2. The bushing according to claim 1 wherein said insulating layer comprises a high-voltage type heat-shrinkage tubing.

3. The bushing according to claim 2 wherein said insulating layer further comprises a halogen-free polyolefin.

4. The bushing according to claim 3 wherein said inner shank has an outer surface, and wherein said insulating layer is in sealing contact with all of said outer surface of said inner shank between said shielding layer and said protruding conducting core.

5. The bushing according to claim 3 wherein said insulating layer comprises a heat shrinkable material that is shrunk into direct contact with said outer surface.

6. A bolt-mounted bushing suitable for use in gas-insulated switchgear, comprising:

a body having an inner shank, an outer shank and a radially extending flange between said inner shank and said outer shank;

a conducting core extending through said body and protruding from said inner shank;

a semiconductive shielding layer on at least a portion of an outer surface of said body and axially spaced apart from said protruding conducting core;

an insulating layer sealingly affixed to and covering said inner shank between said shielding layer and said protruding conducting core and overlapping at least a portion of said shielding layer, such that the bushing is capable of being used in gas-insulated switchgear without arc tracking, even though the bushing would not be capable of such use absent said insulating layer.

7. The bushing according to claim 6 wherein said shielding layer has an inner edge defined as the portion of said shielding layer nearest said protruding conducting core and said insulating layer overlaps said inner edge of said shielding layer.

* * * * *